US006308768B1

(12) United States Patent
Rice et al.

(10) Patent No.: US 6,308,768 B1
(45) **Date of Patent: *Oct. 30, 2001**

(54) APPARATUS AND METHOD FOR SEMI-SOLID MATERIAL PRODUCTION

(75) Inventors: Christopher S. Rice; Patricio F. Mendez, both of Cambridge; Stuart B. Brown, Needham; Shinya Myojin, Cambridge, all of MA (US)

(73) Assignee: Semi-Solid Technologies, Inc., Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/252,743

(22) Filed: Feb. 19, 1999

Related U.S. Application Data

(63) Continuation of application No. 08/726,099, filed on Oct. 4, 1996, now Pat. No. 5,887,640.

(60) Provisional application No. 60/027,595, filed on Oct. 4, 1996.

(51) Int. Cl.[7] ..... B22D 1/00

(52) U.S. Cl. ..... 164/133; 164/113; 164/900; 164/71.1

(58) Field of Search ..... 164/900, 71.1, 164/113, 312, 335, 337, 133, 136; 75/10.65, 10.67, 10.14; 148/549

(56) References Cited

U.S. PATENT DOCUMENTS

| | | |
|---|---|---|
| 2,745,153 | 5/1956 | Burkett . |
| 3,157,923 | 11/1964 | Hodler . |
| 3,222,776 | 12/1965 | Kawecki . |
| 3,528,478 | 9/1970 | Koch et al. . |
| 3,902,544 | 9/1975 | Flemings et al. . |

(List continued on next page.)

FOREIGN PATENT DOCUMENTS

| | | |
|---|---|---|
| 2320761 | 11/1974 | (DE) . |
| 0 476 843 A1 | 3/1992 | (EP) . |
| 0 657 235 A1 | 6/1995 | (EP) . |
| 0 719 606 A1 | 7/1996 | (EP) . |
| 0 761 344 A2 | 3/1997 | (EP) . |

(List continued on next page.)

OTHER PUBLICATIONS

Thesis: "The Machine Casting of High Temperature Semi–Solid Materials," By Danial G. Backman, Massachusetts Institute of Technology, Sep. 1975.

"A World Wide Assessment of Rapid Prototyping Technologies," RF Aubin United Technologies Research Center Report No. 94–13, dated Jan. 1994, 29 pages.

H.L. Marcus and D.L. Bourell, "Solid Freeform Fabrication," *Advanced Materials & Processes*, dated Sep. 1993, pp. 28–31 and 34–35.

S.B. Brown and M.C. Flemings, "Net–Shape Forming Via Semi–Solid Processing," *Advanced Materials & Processes*, dated Jan. 1993, pp. 36–40.

(List continued on next page.)

*Primary Examiner*—Tom Dunn
*Assistant Examiner*—Kevin P. Kerns
(74) *Attorney, Agent, or Firm*—Testa, Hurwitz & Thibeault, LLP

(57) ABSTRACT

An apparatus and process is provided for producing a semi-solid material suitable for directly casting into a component wherein the semi-solid material is formed from a molten material and the molten material is introduced into a container. Semi-solid is produced therefrom by agitating, shearing, and thermally controlling the molten material. The semi-solid material is maintained in a substantially isothermal state within the container by appropriate thermal control and thorough three dimensional mixing. Extending from the container is a means for removing the semi-solid material from the container, including a temperature control mechanism to control the temperature of the semi-solid material within the removing means.

18 Claims, 4 Drawing Sheets

U.S. PATENT DOCUMENTS

| | | | | |
|---|---|---|---|---|
| 3,907,192 | | 9/1975 | Grictens . | |
| 3,920,223 | | 11/1975 | Krueger . | |
| 3,932,980 | | 1/1976 | Mizutani et al. . | |
| 3,936,298 | | 2/1976 | Mehrabian et al. . | |
| 3,948,650 | | 4/1976 | Flemings et al. . | |
| 3,951,651 | * | 4/1976 | Mehrabian et al. | 164/900 |
| 3,955,802 | | 5/1976 | de Bruyne . | |
| 3,979,026 | | 9/1976 | Lee . | |
| 3,993,290 | | 11/1976 | Kovich . | |
| 4,008,883 | | 2/1977 | Zubieta . | |
| 4,049,204 | | 9/1977 | McKee . | |
| 4,065,105 | | 12/1977 | Lussiez et al. . | |
| 4,072,543 | | 2/1978 | Coldren et al. . | |
| 4,089,680 | | 5/1978 | Flemings et al. . | |
| 4,108,643 | | 8/1978 | Flemings et al. . | |
| 4,116,423 | | 9/1978 | Bennett . | |
| 4,124,307 | | 11/1978 | Anisic . | |
| 4,194,552 | | 3/1980 | Bennett . | |
| 4,215,628 | | 8/1980 | Dodd, Jr. . | |
| 4,229,210 | | 10/1980 | Winter et al. . | |
| 4,231,664 | | 11/1980 | Flock et al. . | |
| 4,278,355 | | 7/1981 | Forberg . | |
| 4,305,673 | | 12/1981 | Herbst . | |
| 4,310,124 | | 1/1982 | Schwing et al. . | |
| 4,310,352 | | 1/1982 | Manfre et al. . | |
| 4,345,637 | | 8/1982 | Flemings et al. . | |
| 4,347,889 | | 9/1982 | Komatsu et al. . | |
| 4,361,404 | | 11/1982 | Colin et al. . | |
| 4,373,950 | | 2/1983 | Shingu et al. . | |
| 4,382,685 | | 5/1983 | Pearson . | |
| 4,390,285 | | 6/1983 | Durr et al. . | |
| 4,397,687 | | 8/1983 | Bye . | |
| 4,434,837 | | 3/1984 | Winter et al. . | |
| 4,436,429 | | 3/1984 | Strong et al. . | |
| 4,453,829 | | 6/1984 | Althouse, III . | |
| 4,469,444 | | 9/1984 | Gmeiner et al. . | |
| 4,482,012 | | 11/1984 | Young et al. . | |
| 4,506,982 | | 3/1985 | Smithers et al. . | |
| 4,534,657 | | 8/1985 | Clement . | |
| 4,565,241 | | 1/1986 | Young . | |
| 4,565,242 | | 1/1986 | Young . | |
| 4,580,616 | | 4/1986 | Watts . | |
| 4,620,795 | | 11/1986 | Diebold et al. . | |
| 4,635,706 | | 1/1987 | Behrens | 164/500 |
| 4,687,042 | | 8/1987 | Young . | |
| 4,694,881 | | 9/1987 | Busk . | |
| 4,694,882 | | 9/1987 | Busk . | |
| 4,709,746 | | 12/1987 | Young et al. . | |
| 4,771,818 | | 9/1988 | Kenney . | |
| 4,775,239 | | 10/1988 | Martinek et al. . | |
| 4,799,801 | | 1/1989 | Bruning . | |
| 4,799,862 | | 1/1989 | Davidson et al. . | |
| 4,804,034 | | 2/1989 | Leatham et al. . | |
| 4,865,808 | | 9/1989 | Ichikawa et al. . | |
| 4,874,471 | | 10/1989 | Wilmotte . | |
| 4,893,941 | | 1/1990 | Wayte . | |
| 4,926,924 | | 5/1990 | Brooks et al. . | |
| 4,958,678 | | 9/1990 | Kawamura et al. . | |
| 4,964,455 | | 10/1990 | Meyer . | |
| 5,009,844 | | 4/1991 | Laxmanan . | |
| 5,037,209 | | 8/1991 | Wyss . | |
| 5,110,547 | | 5/1992 | Kuichi et al. . | |
| 5,121,329 | | 6/1992 | Crump . | |
| 5,135,564 | | 8/1992 | Fujikawa et al. . | |
| 5,144,998 | | 9/1992 | Harai et al. . | |
| 5,161,601 | | 11/1992 | Abis et al. . | |
| 5,161,888 | | 11/1992 | Hauck . | |
| 5,178,204 | | 1/1993 | Kelly et al. . | |
| 5,186,236 | | 2/1993 | Gabathuler et al. . | |
| 5,219,018 | | 6/1993 | Meyer . | |
| 5,257,657 | | 11/1993 | Gore . | |
| 5,287,719 | | 2/1994 | Moritaka et al. . | |
| 5,313,815 | | 5/1994 | Nichting et al. . | |
| 5,342,124 | | 8/1994 | Swisher, Jr. . | |
| 5,343,926 | | 9/1994 | Cheskis, et al. . | |
| 5,375,645 | | 12/1994 | Brueker et al. . | |
| 5,381,847 | | 1/1995 | Ashok et al. . | |
| 5,388,633 | * | 2/1995 | Mercer, II et al. | 164/337 |
| 5,411,330 | | 5/1995 | Arutyunov et al. . | |
| 5,464,053 | | 11/1995 | Moschini . | |
| 5,478,148 | | 12/1995 | Thomas et al. . | |
| 5,836,372 | * | 11/1998 | Kono | 164/900 |

FOREIGN PATENT DOCUMENTS

| | | | | |
|---|---|---|---|---|
| 0 765 945 A1 | | 4/1997 | (EP) . | |
| 6250065 | | 3/1987 | (JP) . | |
| 63-199016 | | 8/1988 | (JP) . | |
| 1-178345 | * | 7/1989 | (JP) | 164/900 |
| 01-313164 | | 12/1989 | (JP) . | |
| 1-306047 | * | 12/1989 | (JP) | 164/900 |
| 732073 | | 5/1980 | (RU) . | |
| 87/06624 | | 11/1987 | (WO) . | |
| 95/34393 | | 12/1995 | (WO) . | |
| WO 97/12709 | | 4/1997 | (WO) . | |

OTHER PUBLICATIONS

J.W. Comb and W.R. Priedeman, Stratasys, Inc., "Control Parameters and Material Selection Criteria for Rapid Prototyping Sytems," copyright date 1993, pp. 86–93.

Stratasys, Inc., "Rapid Prototyping Using FDM: A Fast, Precise, Safe Technology," paper from the Solid Freeform Fabrication Symposium, Aug. 3–5, 1992, pp. 301–308.

R.E. Reed–Hill and R. Abbaschian, *Physical Metallurgy Principles*, PWS–KENT Publishing Company, 1992, pp. 325–349.

M.E. Orme, K. Willis and J. Courter, Department of Mechanical and Aerospace Engineering, University of California–Irvine, "The Development of Rapid Prototyping of Metallic Components Via Ultra–Uniform Droplet Deposition," undated, pp. 27–36.

J.W. Comb, W.R. Priedeman and P.W. Turley, Stratasys, Inc. "Control Parameters and Material Selection Criteria for Fused Deposition Modeling," undated, pp. 163–170.

M.C. Flemings and K.P. Young, 9th SDCE International Die Casting Exposition and Congress, Jun. 6–9, 1977, "Thixocasting of Steel," Paper No. G–T77–092, dated Jun. 6–9, 1977, 8 pages.

"Structure and Properties of Thiocast Steels" by K.P. Young, et al., *Metals Technology*, Apr. 1979.

* cited by examiner

APPARATUS AND METHOD FOR SEMI-SOLID MATERIAL PRODUCTION

CROSS REFERENCE TO RELATED APPLICATIONS

This application is a continuation of Ser. No. 08/726,099 filed Oct. 4, 1996 and claims the benefit of U.S. Pat. No. 5,887,640, the disclosure of which is incorporated herein by reference in its entirety. This application also incorporates herein by reference in its entirety related U.S. Provisional Appl. No. 60/027,595 filed Oct. 4, 1996, entitled Apparatus and Method for Integrated Semi-Solid Material Production and Casting.

TECHNICAL FIELD

The present invention relates generally to producing and delivering a semi-solid material slurry for use in material forming processes. In particular, the invention relates to an apparatus for producing a substantially non-dendritic semi-solid material slurry suitable for use in a molding or casting apparatus.

BACKGROUND INFORMATION

Slurry casting or rheocasting is a procedure in which molten material is subjected to vigorous agitation as it undergoes solidification. During normal (i.e. non-rheocasting) solidification processes, dendritic structures form within the material that is solidifying. In geometric terms, a dendritic structure is a solidified particle shaped like an elongated stem having transverse branches. Vigorous agitation of materials, especially metals, during solidification eliminates at least some dendritic structures. Such agitation shears the tips of the solidifying dendritic structures, thereby reducing dendrite formation. The resulting material slurry is a solid-liquid composition, composed of solid, relatively fine, non-dendritic particles in a liquid matrix (hereinafter referred to as a semi-solid material).

At the molding stage, it is well known that components made from semi-solid material possess great advantages over conventional molten metal formation processes. These benefits derive, in large part, from the lowered thermal requirements for semi-solid material manipulation. A material in a semi-solid state is at a lower temperature than the same material in a liquid state. Additionally, the heat content of material in the semi-solid form is much lower. Thus, less energy is required, less heat needs to be removed, and casting equipment or molds used to form components from semi-solids have a longer life. Furthermore and perhaps most importantly, the casting equipment can process more material in a given amount of time because the cooling cycle is reduced. Other benefits from the use of semi-solid materials include more uniform cooling, a more homogeneous composition, and fewer voids and porosities in the resultant component.

The prior art contains many methods and apparatuses used in the formation of semi-solid materials. For example, there are two basic methods of effectuating vigorous agitation. One method is mechanical stirring. This method is exemplified by U.S. Pat. No. 3,951,651 to Mehrabian et al. which discloses rotating blades within a rotating crucible. The second method of agitation is accomplished with electromagnetic stirring. An example of this method is disclosed in U.S. Pat. No. 4,229,210 to Winter et al., which is incorporated herein by reference. Winter et al. disclose using either AC induction or pulsed DC magnetic fields to produce indirect stirring of the semi-solid.

Once the semi-solid material is formed, however, virtually all prior art methods then include a solidifying and reheating step. This so-called double processing entails solidifying the semi-solid material into a billet. One of many examples of double processing is disclosed in U.S. Pat. No. 4,771,818 to Kenney. The resulting solid billet from double processing is easily stored or transported for further processing. After solidification, the billet must be reheated for the material to regain the semi-solid properties and advantages discussed above. The reheated billet is then subjected to manipulation such as die casting or molding to form a component. In addition to modifying the material properties of the semi-solid, double processing requires additional cooling and reheating steps. For reasons of efficiency and material handling costs, it would be quite desirable to eliminate the solidifying and reheating step that double processing demands.

U.S. Pat. No. 3,902,544 to Flemings et al., incorporated herein by reference, discloses a semi-solid forming process integrated with a casting process. This process does not include a double processing, solidification step. There are, however, numerous difficulties with the disclosed process in Flemings et al. First and most significantly, Flemings et al. require multiple zones including a molten zone and an agitation zone which are integrally connected and require extremely precise temperature control. Additionally, in order to produce the semi-solid material, there is material flow through the integrally connected zones. Semi-solid material is produced through a combination of material flow and temperature gradient in the agitation zone. Thus, calibrating the required temperature gradient with the (possibly variably) flowing material is exceedingly difficult. Second, the Flemings et al. process discloses a single agitation means. Thorough and complete agitation is necessary to maximize the semi-solid characteristics described above. Third, the Flemings et al. process is lacking an effective transfer means and flow regulation from the agitation zone to a casting apparatus. Additional difficulties with the Flemings process, and improvements thereupon, will be apparent from the detailed description below.

A primary object of the present invention is to provide semi-solid material formation suitable for fashioning directly into a component.

Another object of the present invention is to provide a more efficient and cost-effective semi-solid material formation process.

Yet another object of the present invention is to provide an apparatus and a process for forming semi-solid material and maintaining the semi-solid material under substantially isothermal conditions.

An additional object of the present invention is to provide formation of semi-solid material suitable for component formation without a solidification and reheating step.

Still another object of the present invention is to provide a process and apparatus for semi-solid material formation with improved shearing and agitation.

SUMMARY OF THE INVENTION

The present invention provides a method and apparatus for producing a semi-solid material suitable for forming directly into a component comprising a source of molten material, a container for receiving the molten material, thermal control means mounted to the container for controlling the temperature of container, and an agitation means immersed in the material. The agitation means and the thermal controlling means act in conjunction to produce a substantially isothermal semi-solid material in the container. A thermally controlled means is provided for removing the semi-solid material from the container.

DESCRIPTION OF THE PREFERRED EMBODIMENT

Figure 1:
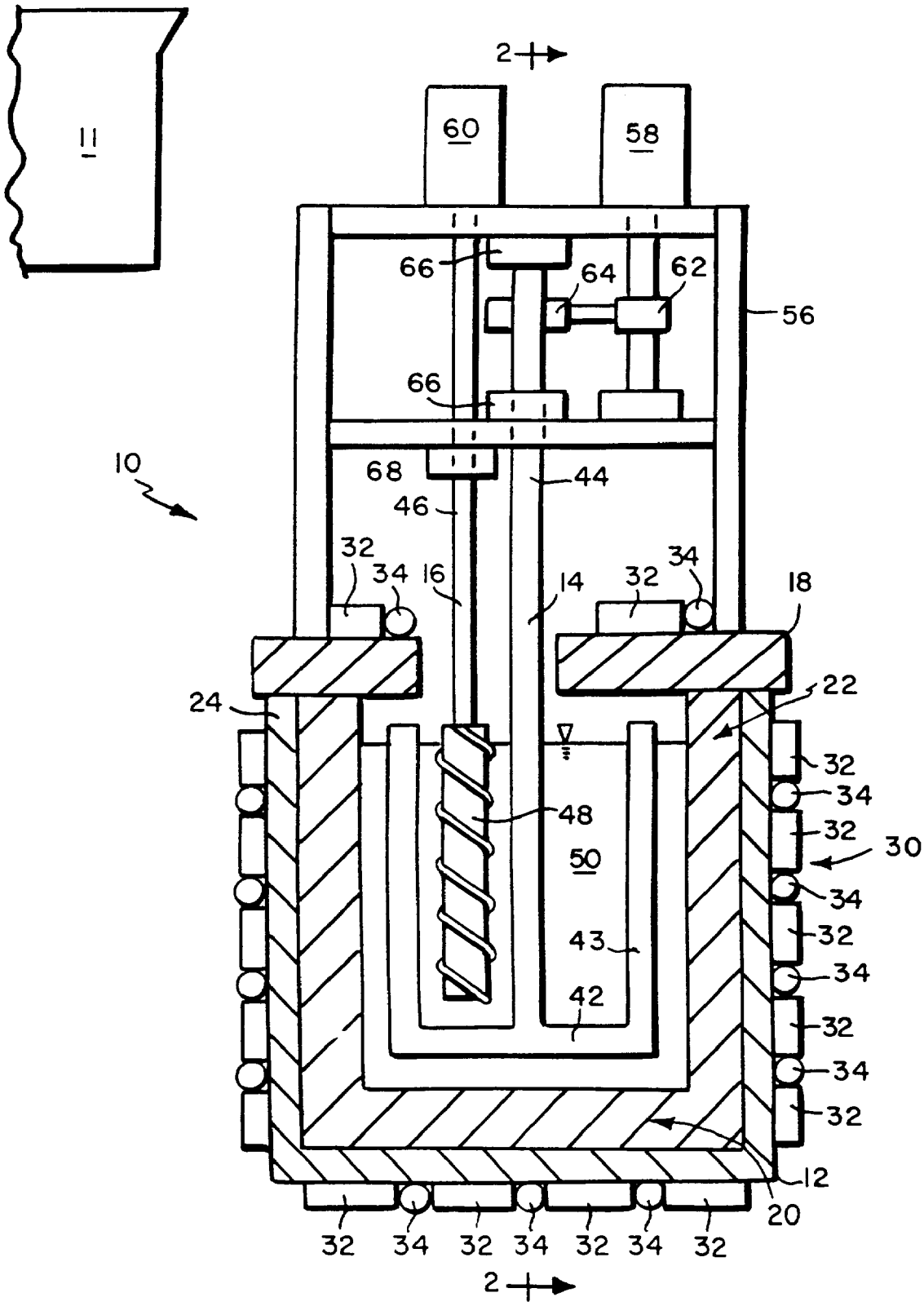
FIG. 1 is a schematic, front sectional view of a semi-solid production apparatus according to the present invention.

In FIG. 1, a semi-solid production apparatus is shown generally as reference numeral 10. Separated from the apparatus 10 is a source of molten material 11. Generally any material which may be processed into a semi-solid material 50 is suitable for use with this apparatus 10. Suitable molten materials 11 include pure metals such as aluminum or magnesium, metal alloys such as steel or aluminum alloy A356, and metal-ceramic particle mixtures such as aluminum and silicon carbide.

The apparatus 10 includes a cylindrical chamber 12, a primary rotor 14, a secondary rotor 16, and a chamber cover 18. The chamber 12 has a inner bottom wall 20 and a cylindrical inner side wall 22 which are both preferably made of a refractory material. The chamber 12 has an outer support layer 24 preferably made of steel. The top of the chamber 12 is covered by a chamber cover 18. The chamber cover 18 similarly has a refractory material layer.

Thermal control system 30 comprises heating segments 32 and cooling segments 34. The heating and cooling segments 32, 34 are mounted to, or embedded within, the outer layer 24 of the chamber 12. The heating and cooling segments 32, 34 may be oriented in many different ways, but as shown, the heating and cooling segments 32, 34 are interspersed around the circumference of the chamber 12. Heating and cooling segments 32, 34 are also mounted to the chamber cover 18. Individual heating and cooling segments 32, 34 may independently add and/or remove heat, thus enhancing the controllability of the temperature of the contents of the chamber 12.

The primary rotor 14 has a rotor end 42 and a shaft 44 which extends upwards from the rotor end 42. The primary rotor shaft 44 extends through the chamber lid 18. The rotor end 42 is immersed in and entirely surrounded by the chamber 12. As shown in FIG. 1, the rotor end 42 has L-shaped blades 43, preferably two such blades spaced 180 degrees apart, extending from the bottom of the rotor end 42. The L-shaped blades 43 have two portions, one of which is parallel to the inner side wall 22 and the other being parallel to the inner bottom wall 20. The L-shaped blades 43, when rotated, shear dendrites which tend to form on the inner side wall 22 and bottom wall 20 of the chamber 12. Additionally, the rotation of the blades 43 promotes material mixing within horizontal planes. Other blade 43 geometries (e.g. T-shaped) should be effective so long as the gap between the chamber inner side wall 22 and the blades 43 is small. It is desirable that this gap be less than two inches. Furthermore, to promote additional shearing, the gap between the chamber bottom 20 and the blades 43 also should be less than two inches. A typical rotation speed of the shear rotor 14 is approximately 30 rpm.

The secondary rotor 16 has a rotor end 48 and a shaft 46 extending from the rotor end 48. The shape of the rotor end 48 should be designed to encourage vertical mixing of the semi-solid material 50 and enhance the shearing of the semi-solid material 50. The rotor end 48 is preferably auger-shaped or screw-shaped, but many other shapes, such as blades tilted relative to a horizontal plane, will perform similarly. The shaft 46 extends upwardly from the auger-shaped rotor end 48. Depending on the rotational direction of the secondary rotor 16, material in chamber 12 is forced to move in either an upwards or downwards direction. A typical rotation speed of the secondary rotor 16 is 300 rpm. The primary rotor 14 and the secondary rotor 16 are oriented relative to the chamber 12 and to each other so as to enhance both the shearing and three dimensional agitation of a semi-solid material 50. In FIG. 1 it is seen that the primary rotor 14 revolves around the secondary rotor 16. The secondary rotor 16 rotates within the predominantly horizontal mixing action of the primary rotor 14. This configuration promotes thorough, three-dimensional mixing of the semi-solid material 50. Although FIG. 1 depicts a plurality of rotors, a single rotor that provides the appropriate shearing and mixing properties may be utilized. Such a single rotor must afford both shearing and mixing, the mixing being three-dimensional so that the semi-solid material 50 in the container 12 is maintainable at a substantially uniform temperature.

The semi-solid material environment into which the rotors 14, 16 are immersed is quite harsh. The rotors 14, 16 are exposed to very high temperatures, often corrosive conditions, and considerable physical force. To combat these conditions, the preferred composition of the rotors 14, 16 is a heat and corrosion resistant alloy like stainless steel with a high-temperature $MgZrO_3$ ceramic coating. Other high-temperature resistant materials, such as a superalloy coated with $Al_2O_3$, are also suitable.

A frame 56 is mounted to the chamber lid 18. The frame 56 supports a primary drive motor 58 and a secondary drive motor 60. The respective motors 58, 60 are mechanically coupled to the shafts 44, 46 of the respective rotors 14, 16. As shown in FIG. 1, the primary motor 58 is coupled to the primary rotor shaft 44 by a pair of reduction gears 62 and 64. The primary rotor shaft 44 is supported in the frame 56 by bearing sleeves 66. Similarly, the secondary rotor shaft 46 is supported in frame 56 by bearing sleeve 68. Both motors 58, 60 may be connected to the rotors through reduction or step-up gearing to improve power and/or torque transmission.

An alternative to the mechanical stirring described above is electromagnetic stirring. An example of electromagnetic stirring is found in Winter et al., U.S. Pat. No. 4,229,210. Electromagnetic agitation can effectuate the desired isotropic and three-dimensional shearing and mixing properties crucial to the present invention.

Molten material 11 may be delivered to the chamber 12 in a number of different fashions. In one embodiment, the molten material 11 is delivered through an orifice 70 in the chamber cover 18. Alternatively, the molten metal 11 may be delivered through an orifice in the side wall 22 (not shown) and/or through an orifice in the bottom wall 20 (also not shown).

Semi-solid material 50 is formed from the molten material 11 upon agitation by the primary rotor 14 and the secondary rotor 16, and appropriate cooling from the thermal control system 30. After an initial start-up cycle, the process is semi-continuous whereby as semi-solid material 50 is removed from the chamber 12, molten material 11 is added. However, the rotors 14, 16 and the thermal control system 30 maintain the semi-solid 50 in a substantially isothermal state.

In addition to controlling the temperature of the chamber 12 thereby maintaining the semi-solid material 50 in a substantially isothermal state, the thermal control system 30 is also instrumental in starting up and shutting down the apparatus 10. During start-up, the thermal control system should bring the chamber 12 and its contents up to the appropriate temperature to receive molten material 11. The chamber 12 may have a large amount of solidified semi-solid material or solidified (previously molten) material remaining in it from a previous operation. The thermal control system 30 should be capable of delivering enough power to re-melt the solidified material. Similarly, when shutting down the apparatus 10, it may be desirable for the thermal control system 30 to heat up the semi-solid material 50 in order to fully drain the chamber 12. Another shut-down procedure may entail carefully cooling the semi-solid 50 into the solid state.

Figure 2:
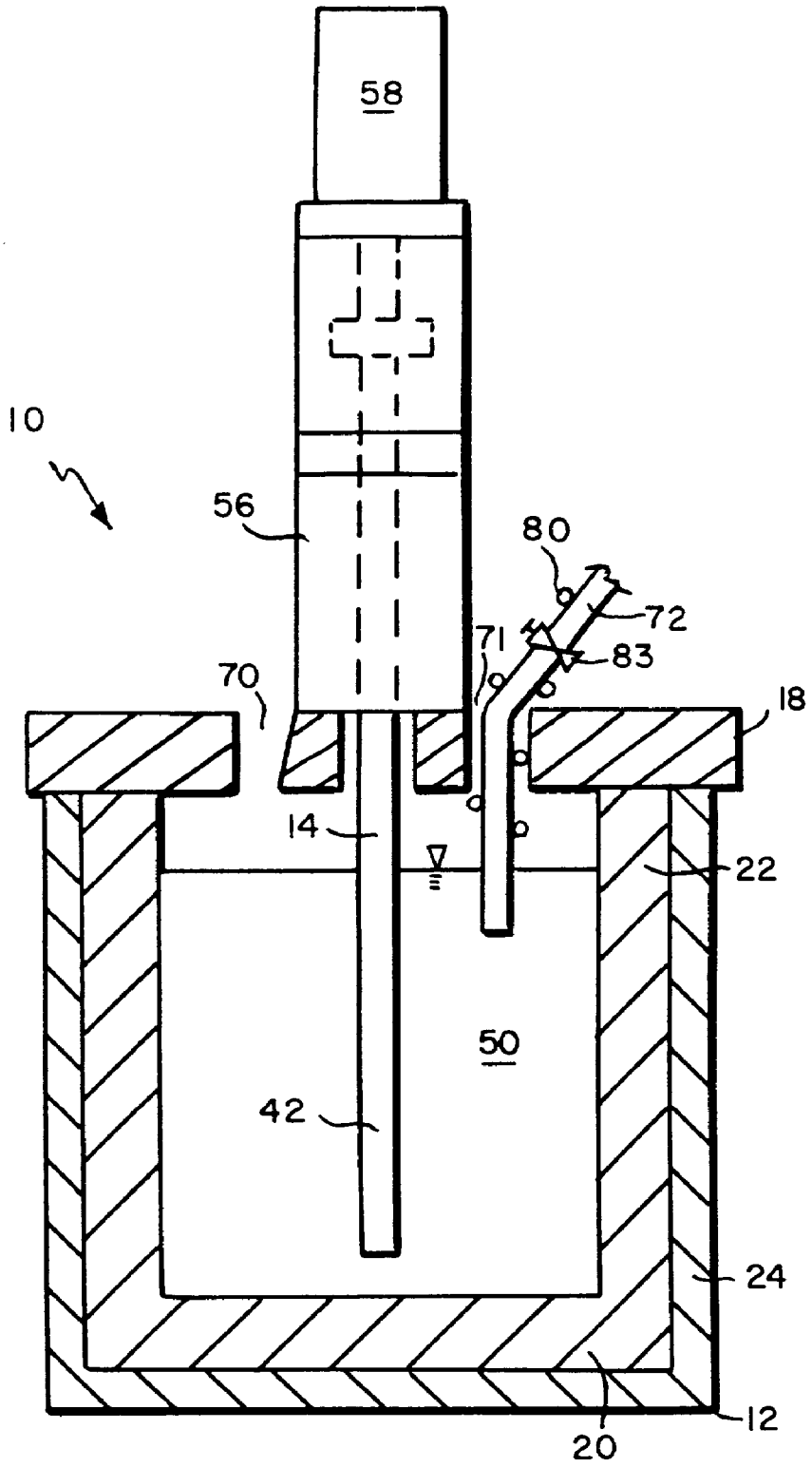
FIG. 2 is a schematic, side sectional view of the apparatus of FIG. 1.

As shown in FIG. 2, removal of semi-solid material 50 formed in the chamber 12 is preferably via a removal port 72 which extends through an orifice 71 in cover 18. One end of the removal port 72 must be below the surface of the semi-solid material 50. The removal port 72 is insulated and protects the semi-solid material 50 from being contaminated by the ambient atmosphere. Without such protection, oxidation would more readily occur on the outside of the semi-solid material and intersperse in any components made therefrom. Provided around the removal port 72 is a heater 80 to maintain the semi-solid material 50 at the desired temperature.

Figure 3:
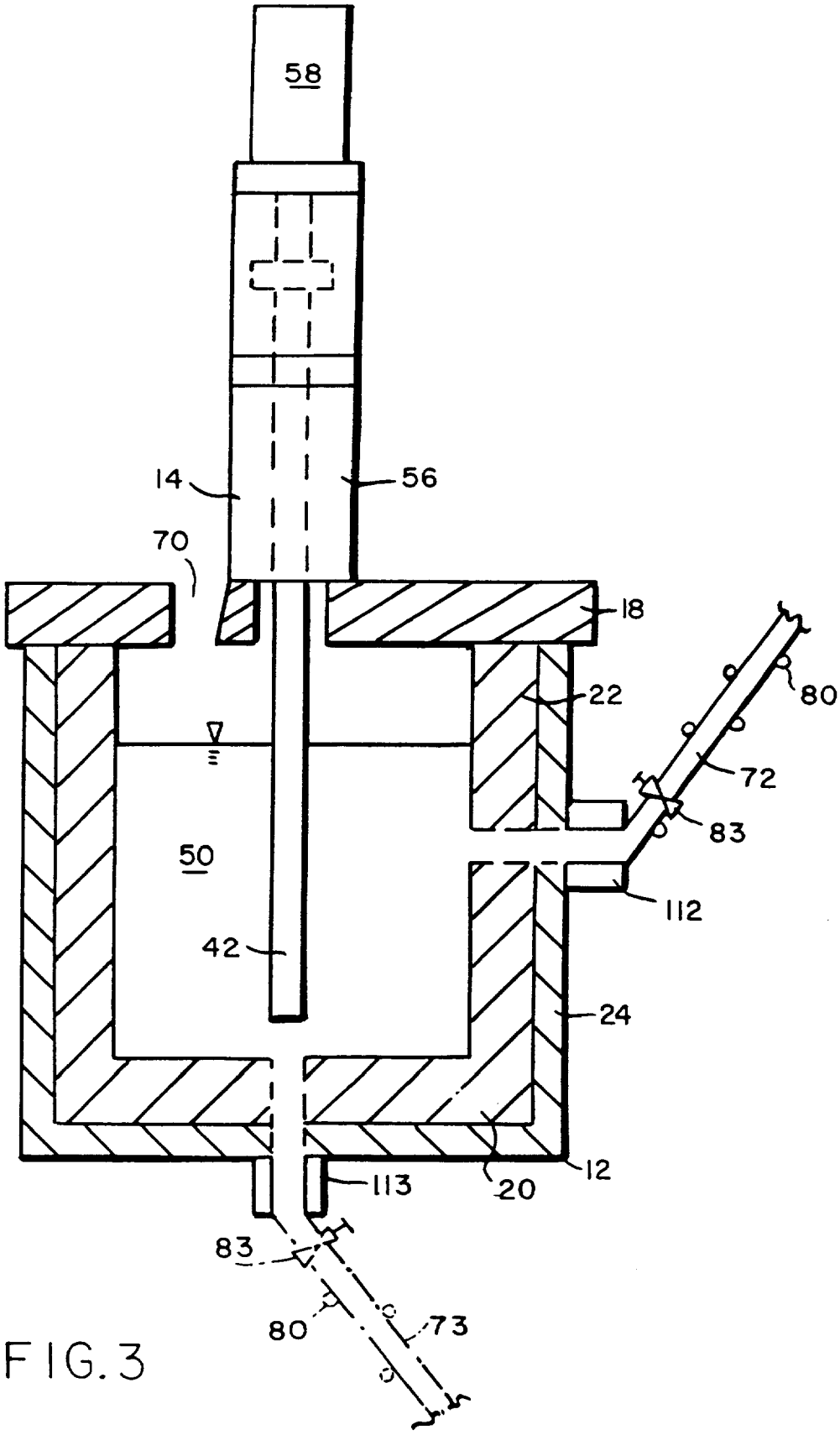
FIG. 3 is a schematic, side sectional view of the apparatus of FIG. 2 showing an alternate embodiment of the present invention.

In FIG. 2, the removal port 72 extends from the apparatus 10 through the chamber cover 18. In an alternative preferred embodiment, the removal port 72 extends from the chamber side wall 22 which has an outlet orifice 112 as shown in FIG. 3. Alternatively, FIG. 3 also shows a removal port 73 extending from the bottom wall 20 which has an outlet orifice 113. In either case, as described above, the removal port includes a heater 80 to maintain the isothermal state of the semi-solid material 50 being removed.

Effectuating semi-solid 50 flow through the port 72 may be achieved by any number of methods. A vacuum could be applied to the removal port 72, thus sucking the semi-solid out of the chamber 12. Gravity may be utilized as depicted in FIG. 3 at port 73. Other transfer methods utilizing mechanical means, such as submerged pistons, helical rotors, or other positive displacement actuators which produce a controlled rate of semi-solid material 50 transfer-are also effective.

To further regulate the flow of semi-solid material 50 out of the chamber 12 via any of the removal ports described above, a valve 83 is provided in the port 72. The valve 83 can be a simple gate valve or other liquid flow regulation device. It may be desirable to heat the valve 83 so that the semi-solid 50 is maintained at the desired temperature and clogging is prevented.

Flow regulation may also be crudely effectuated by local solidification. Instead of a valve 83, a heater/cooler (not shown) can locally solidify the semi-solid 50 in port 72 thus stopping the flow. Later, the heater/cooler can reheat the material to resume the flow. This procedure would be part of a start-up and shut-down cycle, and is not necessarily part of the isothermal semi-solid material production process described above.

Figure 4:
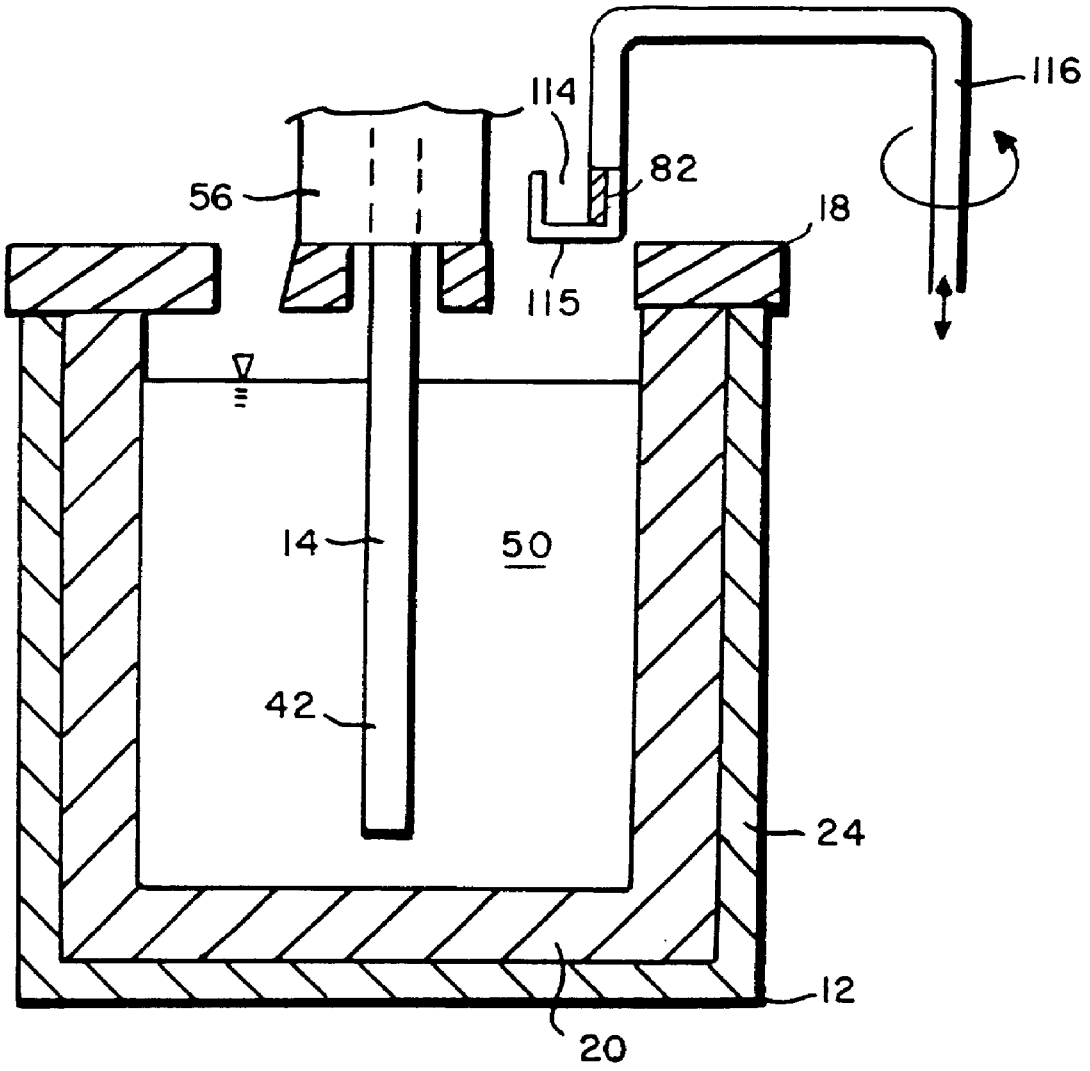
FIG. 4 is a schematic, side sectional view of the apparatus of FIG. 2 showing another alternate embodiment of the present invention.

Another manner for transferring semi-solid material 50, while providing inherent flow control, utilizes a ladle 114 as depicted in FIG. 4. The ladle 114 removes semi-solid material 50 from the chamber 12 while a heater 82 which is mounted to the ladle 114 maintains the temperature of the semi-solid material 50 being removed. A ladle cup 115 of the ladle 114 is attached to a ladle actuator 116. The cup 115 is rotatable to pour out its contents, and the actuator 116 moves the ladle in the horizontal and vertical directions.

To aid in maintaining proper temperature conditions within the chamber 12, semi-solid material 50 transfer may occur in successive cycles. During each cycle the above-described flow regulation allows a discrete amount of semi-solid material 50 to be removed. The amount of semi-solid material removed during each cycle should be small relative to the material remaining in the chamber 12. In this manner, the change in thermal mass within the chamber 12 during removal cycles is small. In a typical cycle, less than ten percent of the semi-solid 50 within chamber 12 is removed.

Once the semi-solid material is removed, it may be transferred directly to a casting device to form a component. Such a casting device includes that described in "Apparatus and Method for Integrated Semi-Solid Material Production and Casting" a provisional application No. 60/027,595 filed Oct. 4, 1996, which is incorporated herein by reference. Other examples of appropriate casting devices include a mold, a forging die assembly as described in the specification of U.S. Pat. No. 5,287,719, or other commonly known die casting mechanisms.

Although not required, it may be desirable to maintain the entire apparatus 10 in a controlled environment (not shown). Oxides readily form on the outer layers of molten materials and semi-solid materials. Contaminants other than oxides also enter the molten and semi-solid material. In an inert environment, such as one of nitrogen or argon, oxide formation would be reduced or eliminated. The inert environment would also result in fewer contaminants in the semi-solid material. It may be more economical, however, to limit the controlled environment to discrete portions of the apparatus 10 such as the delivery of molten material 11 to the chamber 12. Another discrete and economical portion for environmental control may be the removal port 72 (or the ladle 114). At the removal port 72, the semi-solid material 50 no longer undergoes agitation and the material is soon to be cast into a component. Thus, any oxide skin that forms at this stage will not be dispersed throughout the material by mixing in the container 12. Instead, the oxides will be concentrated on the outer layers of the semi-solid. Therefore, to reduce both oxide formation and to reduce high-concentration oxide pockets, a controlled nitrogen environment (or other suitable and economical environment) would be advantageous at the removal port 72 stage.

The following is an example of the above described process and apparatus after the start-up cycle is complete. Molten aluminum at an approximate temperature of 677 degrees Celsius is poured into the chamber 12 already containing a large quantity of semi-solid material. The primary rotor 14 turns at approximately 30 rpm and stirs and shears the aluminum in a clockwise direction. The secondary rotor 16 rotates at about 300 rpm and forces the aluminum upwards and/or downwards while shearing the aluminum also. The combined effect of the two rotors 14, 16 thoroughly agitates and shears the aluminum in three dimensions. The thermal control system 30 maintains the temperature of the aluminum at approximately 600 degrees Celsius such that dendritic structures are formed. The rotors 14, 16 shear the dendritic structures as they are formed. While the thermal control system maintains the temperature of the semi-solid aluminum at approximately 600 degrees Celsius, the rotors 14, 16 continuously mix the semi-solid aluminum keeping the temperature within the material substantially uniform. The solid particle size produced by this particular process is typically in the range of 50 to 200 microns and the percentage by volume of solids suspended in the semi-solid aluminum is approximately 20 percent.

The semi-solid aluminum is transferred from the chamber 12 via removal port 72. The removal port heater 80 also maintains the semi-solid aluminum at 600 degrees Celsius. A component may be formed directly from the removed semi-solid aluminum, without any additional solidification or reheating steps.

While there have been described herein what are considered to be preferred embodiments of the present invention, other modifications of the invention will be apparent to those skilled in the art from the teaching herein. It is therefore desired to be secured in the appended claims all such modifications as fall within the true spirit and scope of the invention. Accordingly, what is desired to be secured by Letters Patent of the United States is the invention as defined and differentiated in the following claims.

We claim:

1. A method of directly producing a component from a semi-solid material, the method comprising the steps of:

providing a container having a material therein, at least a portion of the material initially being in a molten state;

controlling temperature of the material in the container while continuously mechanically mixing substantially all of the material in the container simultaneously using a first mixing means disposed proximate to at least a portion of an interior surface of the container for shearing dendrites from the interior surface and a second mixing means for providing vertical mixing, so as to continuously shear substantially all of the material in the container in order to produce a substantially isothermal semi-solid material therefrom;

removing a portion of the semi-solid material from the container; and directly forming the component with the removed portion of semi-solid material.

2. The method according to claim 1 wherein the removed portion of semi-solid material is small relative to the material remaining in the container.

3. The method according to claim 1 wherein the removed portion of semi-solid material is no more than ten percent of the material remaining in the container.

4. The method according to claim 1 further comprising the step of controlling temperature of the portion of semi-solid material removed from the container prior to directly forming the component.

5. The method according to claim 1 further comprising the step of adding an amount of molten material to the container.

6. The method according to claim 5 further comprising the step of regulating the portion of semi-solid material removed from the container and the amount of molten material added to the container so as to maintain a substantially constant level of material in the container.

7. The method according to claim 1 wherein the forming step comprises forcing the removed semi-solid material into a die to produce a die cast component.

8. The method according to claim 1 wherein the material comprises a first metal.

9. The method according to claim 8 wherein the first metal is selected from the group consisting of aluminum, magnesium, steel, and alloys thereof.

10. The method according to claim 8 wherein the material further comprises a second metal different than that of the first metal.

11. The method according to claim 8 wherein the material further comprises a ceramic.

12. The method according to claim 11 wherein the ceramic comprises silicon carbide.

13. The method according to claim 1 wherein the forming step comprises casting the component.

14. Apparatus for directly producing a component from a semi-solid material, the apparatus comprising:

a container for receiving a material therein, at least a portion of the material initially being in a molten state;

a thermal control system comprising a heating segment for controlling temperature of the material in the container; and an agitating device disposed in the container for continuously mechanically mixing substantially all of the material in the container simultaneously, the agitating device comprising a first mixing means disposed proximate to at least a portion of an interior surface of the container for shearing dendrites from the interior surface and a second mixing means for providing vertical mixing, so as to continuously shear substantially all of the material in the container in order to produce a substantially isothermal semi-solid material therefrom, wherein the container defines an orifice through which a portion of the semi-solid material can be removed from the container for producing the component.

15. The apparatus according to claim 14 further comprising a die caster comprising a die defining a die chamber in which the removed portion of semi-solid material can be forced to produce the component.

16. The apparatus according to claim 15 further comprising a temperature controlled removal port in fluid communication with the die chamber and with the semi-solid material in the container via the container orifice.

17. The apparatus according to claim 15 further comprising a temperature controlled ladle for passing through the container orifice for removing and transferring the portion of semi-solid material to the die caster for forcing into the die chamber.

18. The apparatus according to claim 14 wherein the thermal control system further comprises a cooling segment for controlling the temperature of the material in the container.

* * * * *